US012281549B2

(12) United States Patent
Reed

(10) Patent No.: US 12,281,549 B2
(45) Date of Patent: Apr. 22, 2025

(54) METHODS AND SYSTEMS FOR FRACING

(71) Applicant: GreenWell Engineering LLC, Weatherford, TX (US)

(72) Inventor: Chris Reed, Canton, TX (US)

(73) Assignee: Greenwell Engineering, LLC, Weatherford, TX (US)

( * ) Notice: Subject to any disclaimer, the term of this patent is extended or adjusted under 35 U.S.C. 154(b) by 186 days.

(21) Appl. No.: 18/092,752

(22) Filed: Jan. 3, 2023

(65) Prior Publication Data

US 2024/0218763 A1 Jul. 4, 2024

(51) Int. Cl.

| | |
|---|---|
| ***E21B 43/119*** | (2006.01) |
| ***E21B 17/042*** | (2006.01) |
| ***E21B 23/14*** | (2006.01) |
| ***E21B 43/116*** | (2006.01) |
| ***E21B 43/26*** | (2006.01) |

(52) U.S. Cl.

CPC ..... *E21B 43/119* (2013.01); *E21B 17/042* (2013.01); *E21B 23/14* (2013.01); *E21B 43/116* (2013.01); *E21B 43/26* (2013.01)

(58) Field of Classification Search

CPC ..... E21B 17/042; E21B 23/14; E21B 43/116; E21B 43/119; E21B 43/26

See application file for complete search history.

(56) References Cited

U.S. PATENT DOCUMENTS

| | | | | |
|---|---|---|---|---|
| 9,115,572 | B1 | 8/2015 | Hardesty | |
| 11,047,216 | B2 | 6/2021 | Hardesty et al. | |
| 11,828,115 | B1 * | 11/2023 | Thomas | E21B 17/1085 |
| 2015/0330211 | A1 * | 11/2015 | Kabatek | E21B 23/08 166/250.01 |
| 2020/0224508 | A1 * | 7/2020 | Chapman | E21B 47/008 |
| 2022/0090458 | A1 * | 3/2022 | Porter | E21B 33/1295 |
| 2023/0047958 | A1 * | 2/2023 | Jones | E21B 23/10 |
| 2024/0218763 | A1 * | 7/2024 | Reed | E21B 17/042 |

* cited by examiner

*Primary Examiner* — Daniel P Stephenson

(57) ABSTRACT

A pump down assist sub that utilizes a universal thread pattern that is directly coupled to a setting tool firing head that is coupled to the bottom of a conventional perforating gun system, wherein the pump down assist sub eliminates the need for a setting tool and setting sleeve which reduces the length and weight of the overall tool string.

17 Claims, 4 Drawing Sheets

METHODS AND SYSTEMS FOR FRACING

BACKGROUND INFORMATION

Field of the Disclosure

Examples of the present disclosure relate to a systems and methods associated with wireline pump down tools. More specifically, embodiments are directed towards a pump down assist sub that utilizes a universal thread pattern that is directly coupled to a setting tool firing head which is directly coupled to the bottom of a perforating gun system, wherein the pump down assist sub without a setting tool and setting sleeve reduces the length and weight of the overall pumpdown tool string.

Background

Conventionally, after casing and cementing a well and to achieve Frac/zonal isolation in a Frac operation, a frac plug and perforation guns on a wireline are pushed/pumped downhole to a desired a depth. Then, the frac plug is set and perforation guns are fired above the set frac plug to create conduit for frac fluid. Subsequently, a ball positioned across the frac plug will isolate the well into two sections, enabling the fracing fluid to be pumped to the newly created conduit while isolating it from zones below using the frac plug.

However, situations may occur where it is not required to set a frac plug but it is required to pumpdown perforation guns. Specifically, the lower most interval in a horizontal cased hole may not be required isolation or after a perforating gun misfire in a horizontal cased hole when a frac plug is already set. Currently, setting tools with a setting sleeve are run on the end of wireline even in these situations in order to effectively pump the perforating tool string down the horizontal cased hole.

Conventional frac plugs utilize a mandrel with slips, cones, packers, etc. positioned on the outer diameter of the mandrel, and a setting tool with a setting sleeve to set the frac plug. These elements require substantial length, weight, and width to be added to the wireline tool string, can be prematurely deployed, create a variable outer diameter between the setting sleeve and the bottom of a perforating gun system, and typically have an open passageway. All of these can create issues when the wireline and the frac plug are moved down hole in a first direction, and out of hole in a second direction.

Accordingly, needs exist for systems and methods for a pump down assist sub that is configured to encompass and be directly coupled to the setting tool firing head that is coupled directly to the bottom of a perforating gun string that is constructed from a unitary piece of metal, wherein the pump down assist sub is configured to replace a conventional frac plug setting sleeve and setting tool to reduce overall length and weight of the wireline tool string.

SUMMARY

Embodiments disclosed herein describe systems and methods for a pump down assist sub that is configured to be directly coupled to a setting tool firing head coupled to the bottom of a perforating gun system. The pump down assist sub may utilize a universal thread pattern that is compatible with conventional firing heads, wherein the pump down assist sub may be formed of a unitary piece of metal. This may allow the pump down assist sub to optimize performance while reducing tool string length and weight without any wellbore limitations. In embodiments, the pump down assist sub may include a body with an upper chamber and a lower chamber.

The body may be formed of a single piece of metal, such as steel, and have a variable outer diameter from a proximal end of the body to the distal end of the body. In embodiments, the proximal end of the body may have a first diameter, and the distal end of the body may have a second diameter, wherein the first diameter may be larger in size than the second diameter. The first diameter may be substantially similar to that of the perforating gun system. In embodiments, the body may have a solid middle portion, wherein the middle portion extends from the upper chamber to the lower chamber. This solid middle portion may add in the rigidity of the pump down assist sub, allowing for a pressure rating to 20K psi and allowing the pump down assist sub to have no run speed or temperature limitations.

The body may include a tapered outer diameter between the proximal end of the body and the distal end of the body, which may gradually transition the outer diameter of the body from the first diameter to the second diameter. This gradual transition may be a twenty-to-forty-degree taper, which may reduce the likelihood of getting hung up in the well during retrieval or the likelihood that the body catches or contacts another component in the well. Furthermore, the tapering from the first diameter to the second diameter may be the only change in length of the outer diameter between the proximal end and the distal end of the body. In specific embodiments, no tools, sleeves, components, etc. may be positioned on the outer diameter of the body, allowing the body to have a substantially smooth outer surface.

The upper chamber may be a threaded orifice, compartment, cavity that extends from the most proximal end of the body towards the distal end of the body. The threads of the chamber may be configured to be directly coupled to threads on the outer diameter of a setting tool firing head that is coupled to the bottom of a perforating gun system. In embodiments, the upper chamber may also include an o-ring chamber, which is configured to receive an o-ring of the perforation gun. This may limit communication between the perforating gun and the body.

The lower chamber may be positioned on a distalmost end of the body, and may have an open face. The lower chamber may extend from the distalmost end of the body towards the proximal end of the body. In embodiments, an entirety of the sidewalls of the lower chamber may extend in parallel to a central axis of the body. The lower chamber may have a wider inner diameter than the upper chamber, and may have a shorter length than the upper chamber.

In embodiments, the lower chamber may be configured to funnel, scoop, move, etc. debris into the interior of the body rather than the exterior of the body. In further embodiments, the lower chamber may include at least one hole that extends from an inner diameter of the lower chamber to an outer diameter of the lower chamber. The at least one hole may allow communication and pressure equalization between the inner diameter of the lower chamber and an annulus positioned outside of the lower chamber.

To this end, embodiments may combine the familiarity and geometry of conventional perforating gun while improving the functionality of wireline run in hole by replacing conventional frac plugs, setting tools, and setting sleeves with a pump down assist sub. Embodiments may allow for custom outer diameters of the body, and custom thread patterns to match any desired firing head for a seamless transition.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
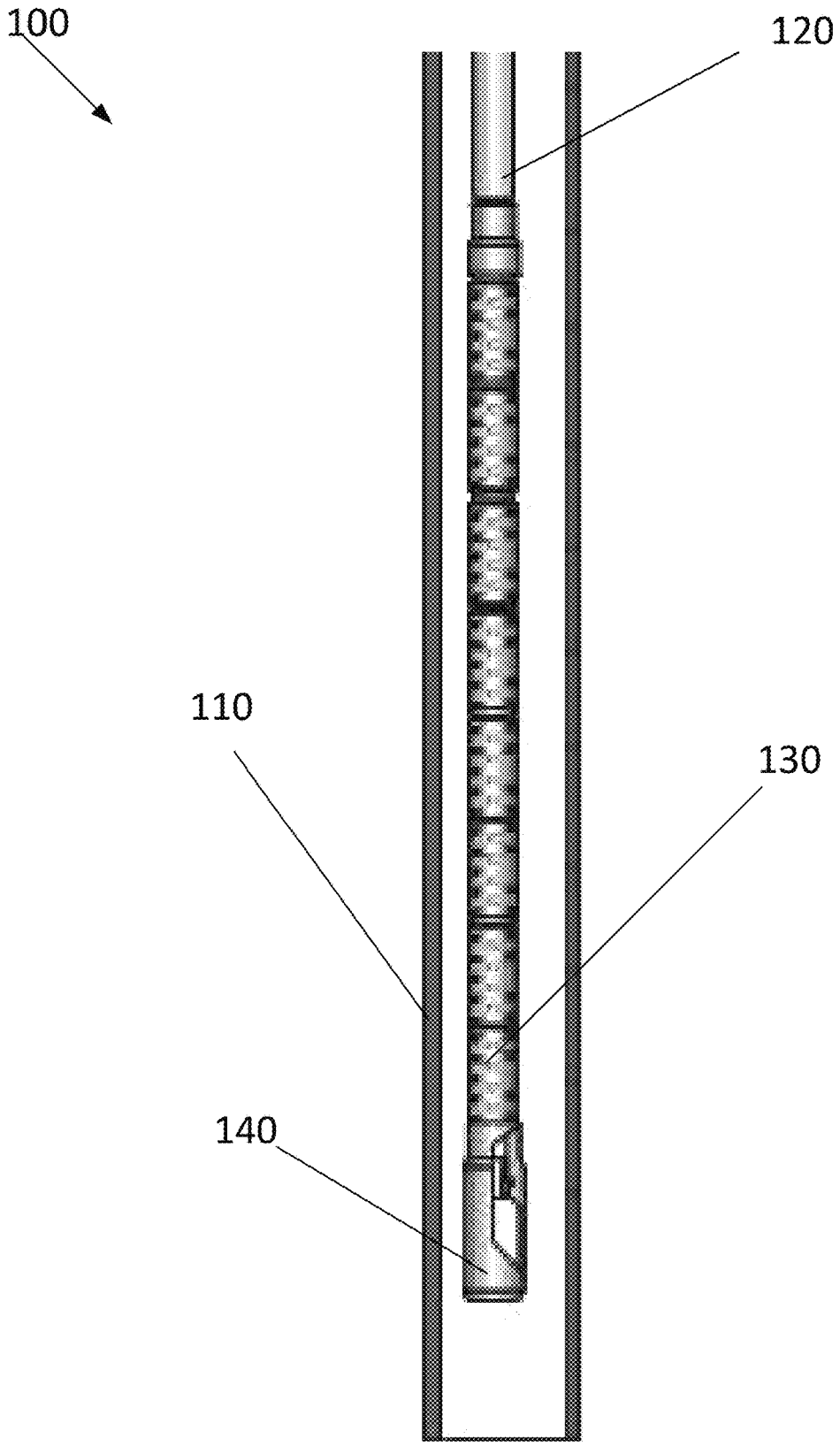
FIG. 1 depicts a downhole tool string utilizing pump down assist sub, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a system 100 utilizing pump down assist sub 140, according to an embodiment. System 100 may include casing 110, wire line 120, perforating guns 130, and pump down assist sub 140.

Casing 110 may be a pipe, series of pipes, etc. that are drilled into a well to stabilize the well, keep contaminants and water out of the oil stream, and prevent oil from leaching into the groundwater. Casing 110 may be installed in layers, sections, etc. In embodiments, it may be desirable to isolate different areas of casing 110.

Wire line 120 may be a strong, thin length of cable mounted on a powered reel. Wire line 120 may be utilized to run perforating guns 130 and other tools downhole within casing 110, after the casing 110 is positioned downhole.

Perforating guns 130 may be devices that are utilized to create openings in casing 110. Each of the perforating guns 130 may include explosive charges to create the openings in casing 110. In embodiments, it may be desirable to isolate different sections of the casing 110 before setting off an explosive charge.

However, it may not be required to isolate casing 110 before detonating an initial, or lowermost, charge within casing 110.

Pump down assist sub 140 may be configured to be directly coupled to a setting tool firing head that is coupled to a perforating gun 130. Pump down assist sub 140 may utilize a universal thread pattern on an inner diameter of a proximal end of the pump down assist sub 140 that is compatible with all plug/play conventional perforating guns 130. In other embodiments, the thread pattern on the proximal end of pump down assist sub 140 may be customized for any desirable perforating gun 130. Pump down assist sub 140 may be constructed of a single, unitary piece, which may be durable and pressure rated to 20K psi with no run speed or temperature limitations. In further embodiments, pump down assist sub 140 may not include any moving parts, additional elements, expandable elements, etc. The simplicity of pump down assist sub 140 may allow pump down assist sub 140 to replace conventional frac plugs or other sealing devices that are conventionally coupled to perforating guns 130. In embodiments, pump down assist sub 140 may be run downhole on the setting tool firing head or bottom gun threads of perforating gun 130 from the surface of the well. In embodiments, pump down assist sub 140 may be around sixteen feet in length, which may be around six feet shorter than a standard frac plug.

Figure 2:
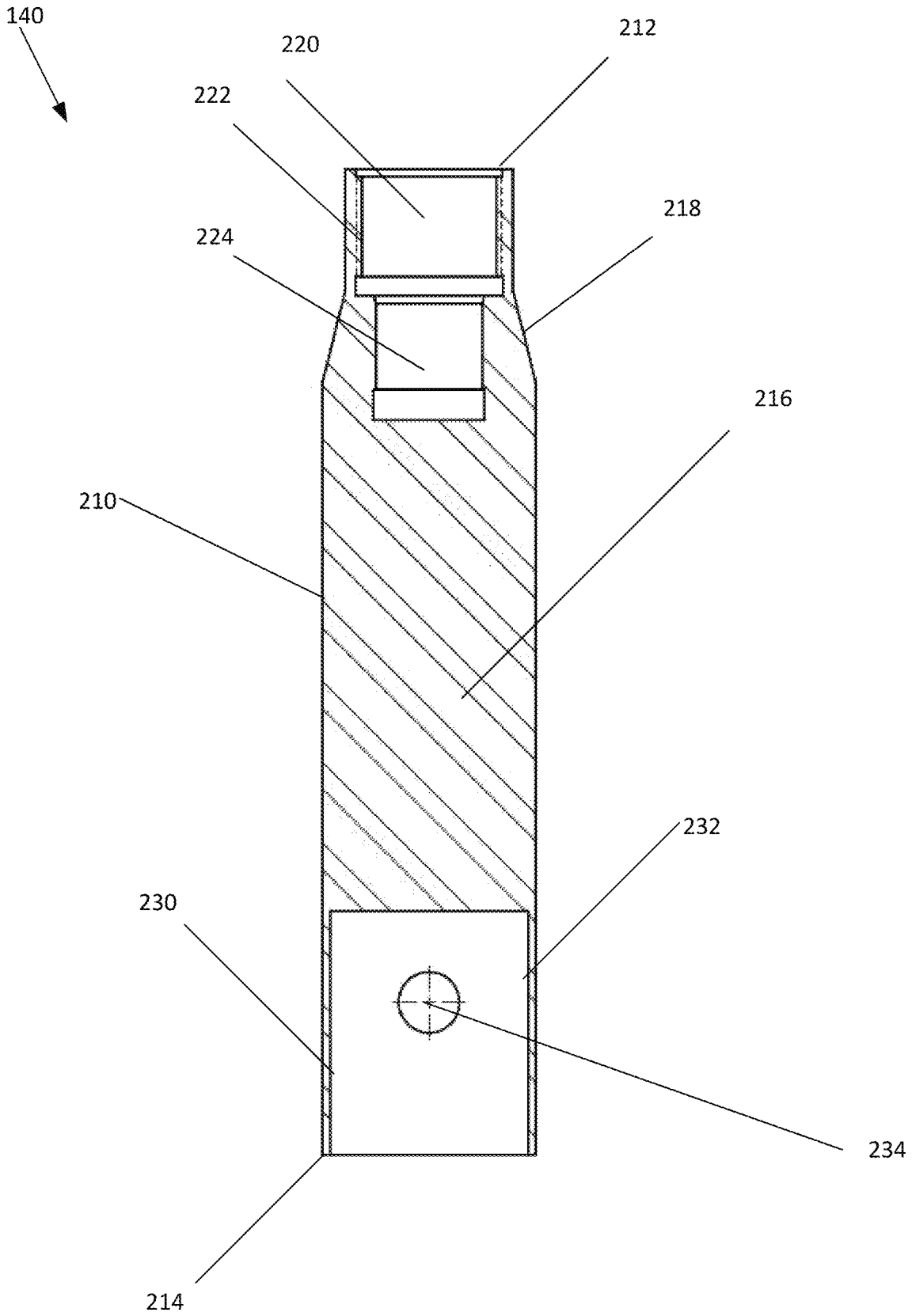
FIG. 2 depicts a pump down assist sub, according to an embodiment.

FIG. 2 depicts a pump down assist sub 140, according to an embodiment. Pump down assist sub 140 may include a body 210 with an upper chamber 220 and a lower chamber 230.

Body 210 may be formed of a single piece of metal, such as steel, and have a variable outer diameter from a proximal end 212 of the body to the distal end 214 of body 210. In embodiments, the proximal 212 may have a first diameter, and distal end 214 may have a second diameter, wherein the first diameter may be larger in size than the second diameter. The first diameter may be substantially similar to that of the perforating gun system. This may limit hang-ups when pulling perforating gun 130 and pump down assist sub 140 out of hole together.

Body 210 may have a solid middle portion 216, wherein the middle portion 216 extends from the upper chamber to the lower chamber. This solid middle portion 216 may add in the rigidity of the pump down assist sub, allowing for a pressure rating to 20K psi and allowing the pump down assist sub to have no run speed or temperature limitations.

Body 210 may include a tapered outer diameter 218 between the proximal end 212 body and the distal end 214. Tapered outer diameter 218 may gradually transition the outer diameter of body 210 from the first diameter to the second diameter. This gradual transition may be a twenty-to-forty-degree taper, which may reduce the likelihood of hang-up during retrieval or the likelihood that the body catches or contacts another component in the well. Furthermore, the tapering from the first diameter to the second diameter may be the only change in length of the outer diameter between the proximal end 212 and distal end 214. In specific embodiments, no tools, sleeves, components, etc. may be positioned on the outer diameter of body 210, allowing body 210 to have a substantially smooth outer surface.

The upper chamber 220 may be a threaded orifice, compartment, cavity that extends from the most proximal end 212 of body 210 towards the distal end 214 of body 210.

Threads 222 positioned on the inner diameter or upper chamber 220 may be configured to be directly coupled to threads on the outer diameter of the bottom of a perforated gun system. In embodiments, upper chamber 220 may also include an o-ring chamber 224, which is configured to receive an o-ring of the perforation gun. This may limit communication between the firing head of the perforating gun and body 210.

Lower chamber 230 may be positioned on a distalmost end of body 210, and may have an open face. Lower chamber 230 may have a wider inner diameter than the upper chamber 33, and may have a shorter length than the upper chamber 220. Lower chamber 230 may extend from the distalmost end of body 210 towards, but not extending to, the proximal end of body 210.

In embodiments, an entirety of the sidewalls 232 of lower chamber 230 may extend in parallel to a central axis of the body. This geometry may allow lower chamber 230 to funnel, scoop, move, etc. debris into the interior of the body 210 rather than the exterior of the body 210. In further embodiments, the lower chamber may include at least one hole 234 that extends from an inner diameter of lower chamber 230 to an outer diameter of lower chamber 230. The at least one hole 234 may allow communication and pressure equalization between the inner diameter of lower chamber 230 and an annulus positioned outside of lower chamber 230, wherein the annulus may be between the outer diameter of lower chamber 230 and the inner diameter of casing 110.

Figure 3:
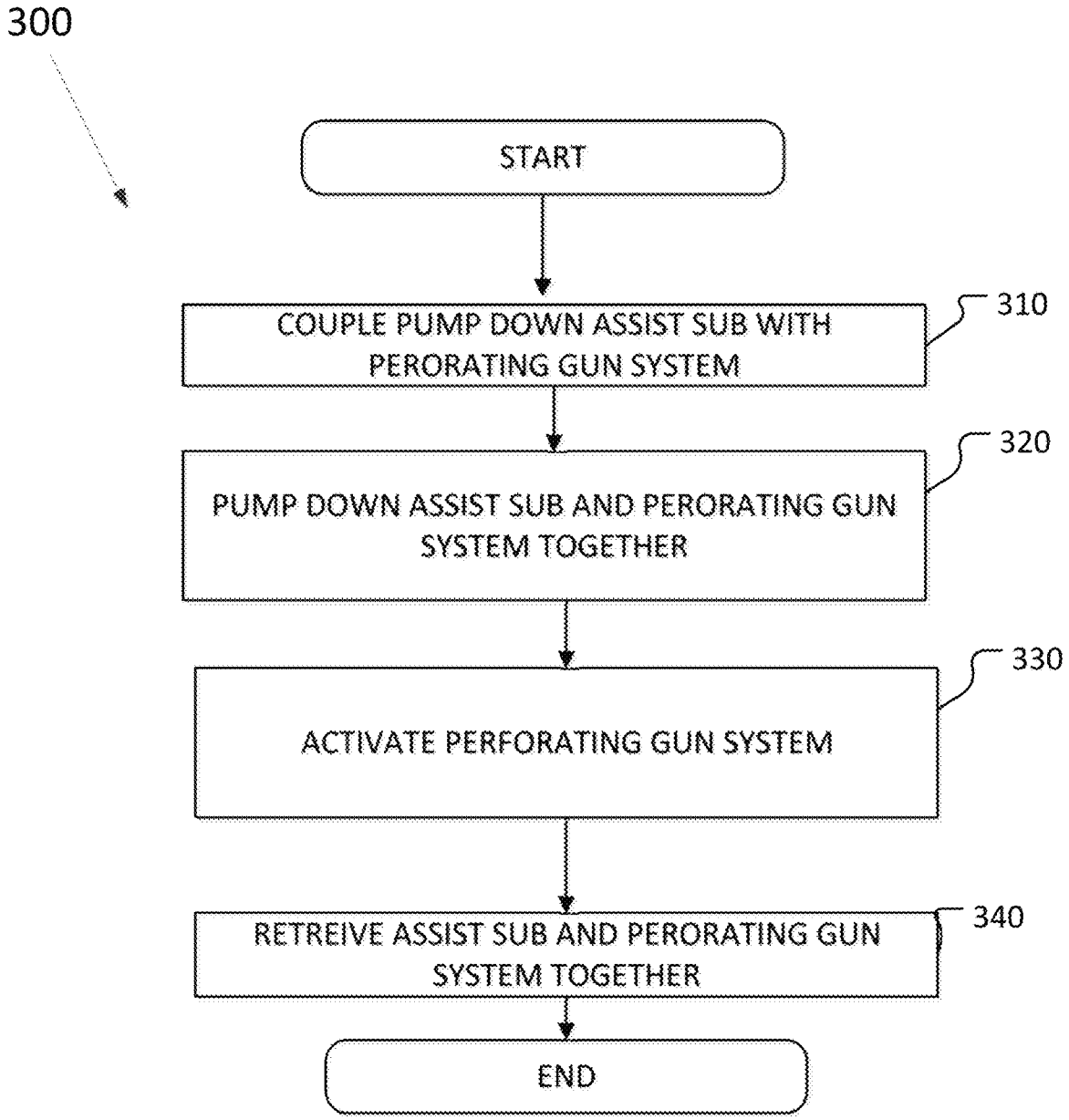
FIG. 3 depicts an operation sequence utilizing a pump down assist sub, according to an embodiment.

FIG. 3 depicts an operation sequence utilizing a pump down assist sub, according to an embodiment. The operational sequence presented below is intended to be illustrative. In some embodiments, operational sequence may be accomplished with one or more additional operations not described, and/or without one or more of the operations discussed. Additionally, the order in which the operations of operational sequence are illustrated in FIG. 3 and described below is not intended to be limiting.

At operation 310, an upper chamber of pump down assist sub may be coupled directly to a setting tool firing head that is directly coupled to a perforating gun system, wherein the perforating gun system is coupled to wireline. More specifically, the firing head may be inserted into, and threaded onto, corresponding threads on an inner diameter of a proximal end of the pump down assist sub, wherein an outer diameter of the proximal end of the pump down assist sub is substantially similar to an outer diameter of the perforating guns.

At operation 320, the pump down assist sub and the perforating gun system may be run in hole from a surface to a desired depth to a lower most desired interval. While the pump down assist sub is being run in hole, a lower chamber of the pump down assist sub may funnel debris into the lower chamber. In embodiments, the lower most desired interval may not require isolation via a frac plug or other isolation devices.

At operation 330, the perforating guns may be activate to cause fractures within the casing and the wellbore.

At operation 340, the perforating gun system, pump down assist sub, and wireline may be pulled out of the hole together. This may allow the perforating gun system to be activate and retrieved along with the pump down assist sub in a single run without positioning and new devices, tools, etc. within the wellbore.

Figure 4:
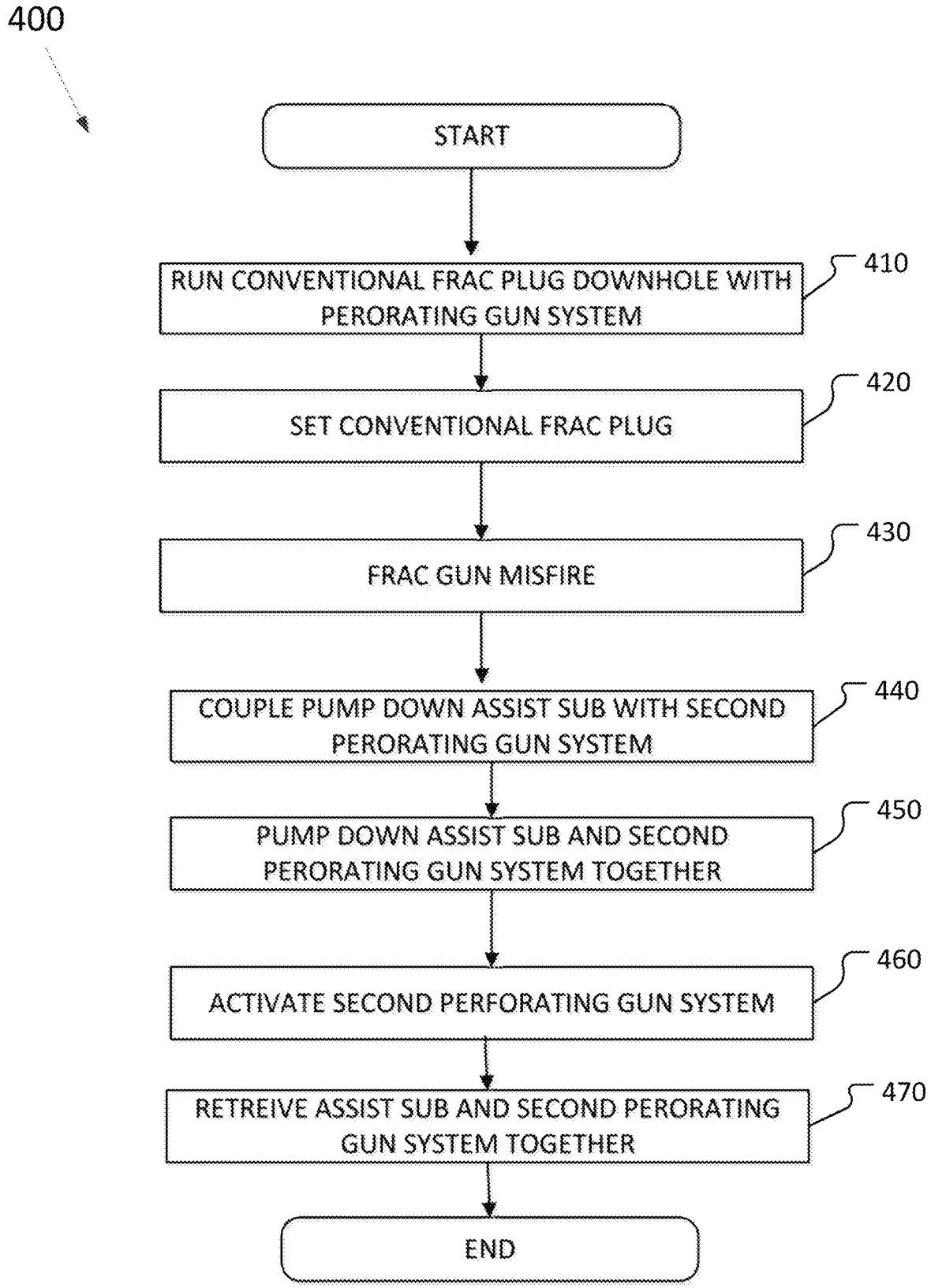
FIG. 4 depicts an operation sequence utilizing a pump down assist sub, according to an embodiment.

FIG. 4 depicts an operation sequence utilizing a pump down assist sub, according to an embodiment. The operational sequence presented below is intended to be illustrative. In some embodiments, operational sequence may be accomplished with one or more additional operations not described, and/or without one or more of the operations discussed. Additionally, the order in which the operations of operational sequence are illustrated in FIG. 3 and described below is not intended to be limiting.

At operation 410, a conventional frac plug may be run downhole in casing on the end of a first perforating gun system to a desired depth.

At operation 420, the conventional frac plug may be set isolating a first area below the frac plug from a second area above the frac plug.

At operation 430, a frac gun misfire of the first perforating gun system may occur within the second area.

At operation 440, an upper chamber of pump down assist sub may be coupled directly to a setting tool firing head coupled to a second perforating gun system, wherein a length of the pump down assist sub is drastically shorter than that of a length of the frac plug.

At operation 450, the pump down assist sub and the second perforating gun system may be run downhole together to a desired location within the second area.

At operation 460, the second perforating gun system may be activated to form fractures within the casing and geological formation within the second area.

At operation 470, the second perforating and the pump down assist may be pulled out of the hole together while the frac plug remains downhole.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A pump down assist sub comprising:

a body formed of a single piece of metal, a lower chamber positioned on a distal end of the body, the lower chamber extending from the distal end of the body towards a proximal end of the body;

an upper chamber positioned on the proximal end of the body, the upper chamber extending from the proximal end of the body towards the distal end of the body, the upper chamber includes a threaded inner diameter that is configured to couple directly to threads on a firing head that is coupled to perforating gun system;

a solid middle portion extending from the lower chamber to the upper chamber.

2. The pump down assist sub of claim 1, wherein the lower chamber includes sidewalls that extending in parallel to a central axis of the pump down assist sub.

3. The pump down assist sub of claim 1, wherein the lower chamber includes at least one port extending from an inner diameter of the lower chamber to the outer diameter of the lower chamber.

4. The pump down assist sub of claim 1, wherein a first inner diameter of the upper chamber is larger than a second inner diameter of the lower chamber.

5. The pump down assist sub of claim 4, wherein the second inner diameter of the lower chamber is larger than a first inner diameter of the upper chamber.

6. The pump down assist sub of claim 1, wherein an outer diameter of the bottom assist sub does not include any additional tools or radially expandable elements.

7. The pump down assist sub of claim 1, wherein an outer diameter of the bottom includes a tapered portion.

8. The pump down assist sub of claim 1, wherein the pump down assist sub is configured to replace a conventional frac plug.

9. A method associated with downhole tools comprising:

coupling an upper chamber positioned on a proximal end of a pump down assist sub directly to threads on perforating gun;

running wire line, the perforating gun, and the pump down assist sub downhole together, the pump down assist sub including a body formed of a single piece of metal, a lower chamber positioned on a distal end of the body, the lower chamber extending from the distal end of the body towards the proximal end of the body, wherein the upper chamber positioned on the proximal end of the body extends from the proximal end of the body towards the distal end of the body, and a solid middle portion extending from the lower chamber to the upper chamber.

10. The method of claim 9, wherein the wire line, the perforating gun, and the pump down assist sub are pulled out of the hole together.

11. The method of claim 9, wherein the perforating gun and the pump down assist sub are run downhole to a lowermost interval in a cased hole.

12. The method of claim 9, wherein the perforating gun and the pump down assist sub are run downhole before a frac plug isolates a first area of a cased hole from a second area of the cased hole.

13. The method of claim 9, wherein the perforating gun and the pump down assist sub are run downhole directly after a frac gun misfire.

14. The method of claim 9, wherein the lower chamber includes sidewalls extending in parallel to a central axis of the pump down assist sub.

15. The method of claim 9, wherein the lower chamber includes at least one port extending from an inner diameter of the lower chamber to the outer diameter of the lower chamber.

16. The method of claim 9, wherein an outer diameter of the bottom assist sub does not include any additional tools or radially expandable elements.

17. The method of claim 9, wherein an outer diameter of the bottom assist sub includes a tapered portion.

* * * * *